US005787989A

United States Patent [19]

Elmenhorst

[11] Patent Number: 5,787,989

[45] Date of Patent: Aug. 4, 1998

[54] APPARATUS FOR PRODUCING FIRE-FIGHTING FOAM

[76] Inventor: Gerrit Elmenhorst, Storåsveien 42B, N-1265 Oslo, Norway

[21] Appl. No.: 553,630

[22] PCT Filed: Jun. 3, 1994

[86] PCT No.: PCT/NO94/00103

§ 371 Date: Apr. 4, 1996

§ 102(e) Date: Apr. 4, 1996

[87] PCT Pub. No.: WO94/28976

PCT Pub. Date: Dec. 22, 1994

[30] Foreign Application Priority Data

Jun. 4, 1993 [NO] Norway ..... 932049

[51] Int. Cl.[6] ..... A62C 31/12

[52] U.S. Cl. ..... 169/14

[58] Field of Search ..... 169/14, 15

[56] References Cited

U.S. PATENT DOCUMENTS 3,393,745 7/1968 Durstewitz .
3,428,131 2/1969 Winslow ..... 169/15
3,441,086 4/1969 Barnes .
3,446,285 5/1969 Hout .
3,607,779 9/1971 King et al. ..... 169/14
3,780,812 12/1973 Lambert ..... 169/15
3,999,612 12/1976 Noguchi .

FOREIGN PATENT DOCUMENTS 1 457 031 10/1966 France .

*Primary Examiner*—Gary C. Hoge
*Attorney, Agent, or Firm*—Cushman Darby & Cushman IP Group of Pillsbury Madison & Sutro LLP

[57] ABSTRACT

It consists of a fan casing (3) and a fan (2) which are operated by a reaction jet motor (6). The reaction jet motor (6) has nozzles (5) and is connected to a liquid under pressure, usually water with a foaming agent added. When the liquid is sprayed from the nozzles (5) the reaction forces will operate the fan (2). The nozzles (5) are designed in such a manner that they give the liquid a cohesive and compact jet with maximum thrust. A grid (9) is located between the nozzles (5) and the foam net (8) for atomization and dispersion of the liquid. The air (4) blows the liquid through the foam net (8) thus generating fire-fighting foam.

6 Claims, 1 Drawing Sheet

APPARATUS FOR PRODUCING FIRE-FIGHTING FOAM

This application claims benefit of international application PCT/NO 94/00103, filed Jun. 3, 1994.

FIELD OF THE INVENTION

The present invention concerns an apparatus for producing fire-fighting foam, a foam generator.

The apparatus has an air inlet and consists of a fan which is operated by a reaction jet motor and a foam net which can be made of a perforated plate. The reaction jet motor has nozzles and is connected to a liquid under pressure. The liquid is usually water to which a foaming agent has been added.

When the liquid is sprayed from the nozzles the reaction forces will operate the fan. At the same time the nozzles will atomize the liquid and spray it against the foam net. The air from the fan blows the liquid through the foam net thus generating foam.

BACKGROUND OF THE INVENTION

From Norwegian patent no. 120 715 there is known a similar apparatus which is operated by a reaction jet motor, for producing fire-fighting foam.

In U.S. Pat. No. 3,999,612 there is disclosed a foam generator where a tilted baffle plate is located outside the nozzles. The baffle plate will deflect the jets of liquid, thus distributing the liquid evenly over the foam net. However, the jets of liquid are not atomized by the baffle plate.

In a foam generator it is desirable to produce as much foam as possible with a high expansion ration in the shortest possible time.

The expansion ratio is usually expressed as how many times a quantity of liquid increases in volume when it is converted into foam. An expansion ratio of 1,000 is achieved when 1 liter of water is converted into 1,000 liters of foam. The fan's rotation speed is crucial for the velocity of the air flow and the volume of air which forces the liquid through the foam net.

An increase in fan speed can be achieved by using nozzles with short moment arms and/or by employing a higher water pressure.

If the water pressure is too great, however, the disadvantage arises that the water jet strikes the foam net with such force that it breaks up its own foam and the foam production is reduced. Known foam generators are encumbered with this defect, and they therefore normally do not operate with a water pressure high than 5 bar.

Another drawback with known foam generators is that the water has to be atomized by the nozzles before it strikes the foam net. If the water is not sufficiently atomized the generator does not produce light foam, i.e. foam with a high expansion ration.

It is known in the prior art to employ nozzles which are designed in such a manner that they atomize water. In addition the nozzles are also constructed in such a way that they disperse the water in a fan shape, so that the water covers the entire foam net. A further flaw in some designs of known foam generators is that the foam net is located in such a manner that the nozzles have to be tilted in relation to the shaft in order for the water jet to be able to cover the entire foam net.

Thus the known foam generators do not take maximum advantage of the available water energy. Atomizing nozzles which also disperse the water in a fan shape, and nozzles which are tilted in relation to the shaft will substantially reduce the thrust. In the case of nozzles tilted at an angle of 45, e.g., the thrust is reduced by approximately 50%, thereby reducing the fan's speed and volume of air. This results in a low foam production.

SUMMARY OF THE INVENTION

The object of the present invention is to avoid the above-mentioned drawbacks.

This problem is solved according to the invention by means of an apparatus which effectively achieves maximum utilization of the available water energy and which is characterized by the features in the claims presented.

BRIEF DESCRIPTION OF THE DRAWINGS

The invention will now be described in more detail with reference to the drawings which illustrates an embodiment of the apparatus, only the principles of the invention being illustrated.

DETAILED DESCRIPTION OF THE INVENTION

Figure 1:
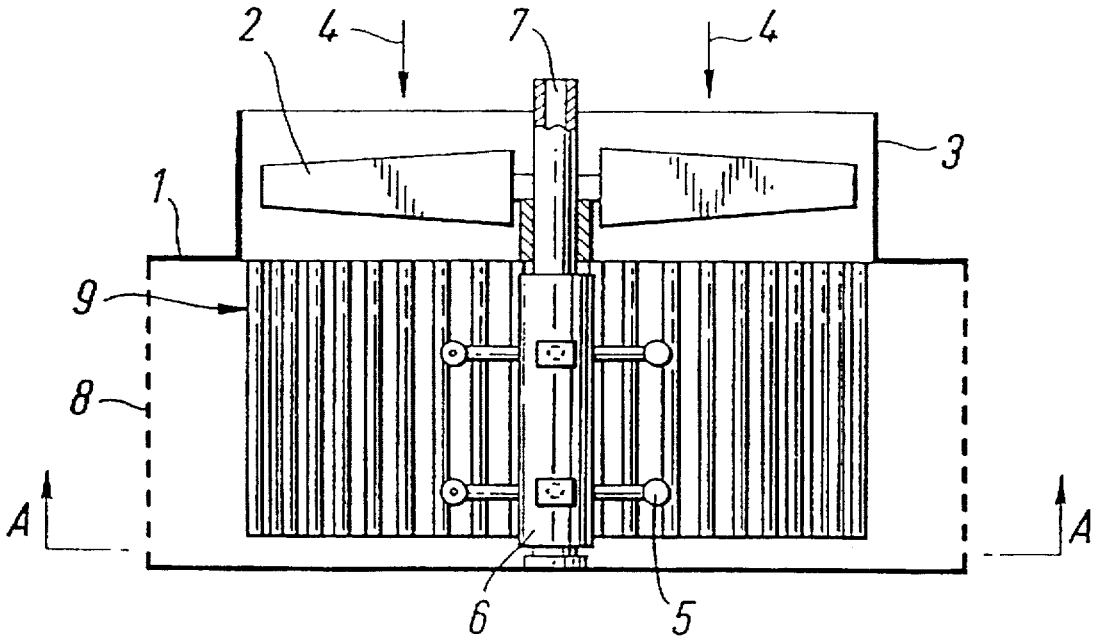
FIG. 1 is a sectional elevation of a foam generator.
Figure 2:
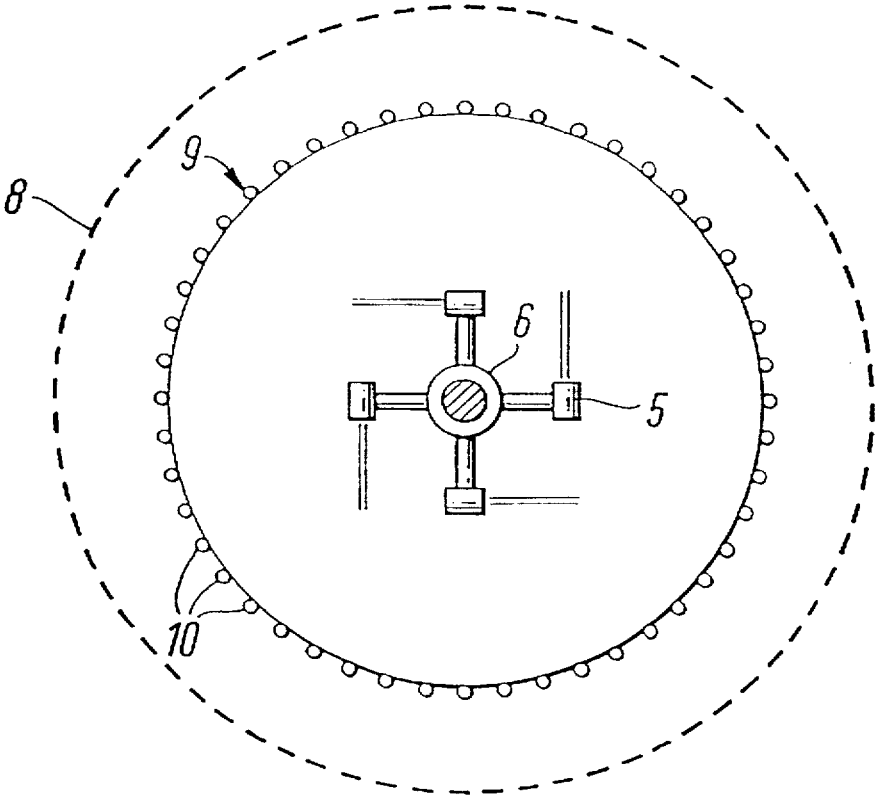
FIG. 2 is a section taken after line A—A in FIG. 1.

In FIG. 1 the foam generator is indicated by 1. It has an axial fan 2 mounted in a fan casing 3 with an air intake. The air supply is indicated by arrows 4. The fan 2 is mounted on the same shaft as a reaction jet motor 6 which consists of a number of nozzles 5 mounted on arms. The nozzles 5 can be located in several planes.

Through the shaft on which the fan 2 and the reaction jet motor 6 are mounted, liquid is supplied to the nozzles 5. The liquid inlet 7 is connected to liquid under pressure from a tank which is not shown in the drawing. The liquid is usually water to which a foaming agent has been added.

A foam net 8 can be constructed as a perforated cylindrical metal wall. Between the nozzles 5 and the foam net 8 there is installed a circular grid 9 mounted parallel to the foam net and at a certain distance from it.

During operation of the foam generator 1 liquid will be sprayed from the nozzles 5 and the reaction forces will operate the fan 2. The nozzles 5 are designed in such a manner that they do not atomize the liquid or disperse it in a fan shape, but spray it out in a straight jet which is cohesive, compact and parallel. Maximum thrust is thereby achieved in the water jet and full use is made of the water energy. This is one of the advantages of the invention.

Nozzles 5 which provide a compact jet are smoothly bored and designed to give a cohesive jet.

The liquid from the nozzles 5 will be dispersed with compact and cohesive liquid jets at high pressure. However, it is important for the liquid to be atomized before it reaches the foam net. This is achieved when the liquid, after having taken maximum advantage of the thrust, strikes the grid 9 and is atomized and dispersed in such a manner that the liquid covers the entire foam net 8. This is one of the advantages of the invention.

The circular grid 9 can be constructed from laths 10 which can be located axially at a certain distance from one another. Other designs of the grid are also possible. It can be constructed, e.g., from a fine-meshed netting or a plate with stamped-out holes, where the holes can have any shape and dimensions, but preferably rectangular and measuring between 10 mm and 100 mm.

When lathes are used they can be made of wires with a circular, oval, triangular or polygonal cross section. Successful tests have been performed, e.g., with a grid 9 constructed from laths 10 made of 2.5 mm diameter round wires made of steel.

The spacing of the laths in the grid 9 will be important for the atomization of the liquid mixture. The spacing will be dependent on the water pressure and the volume of water and the capacity of the foam generator. Appropriate spacings between the laths 10 in the grid 9 can be from 10 mm to 60 mm, preferably from 20 mm to 40 mm.

The radial distance of the laths or the grid from a centre line or from the nozzle outlets is determined by the water pressure and the relevant dimensions in the foam generator.

By means of the grid 9 an even atomization of the liquid is obtained when it is sprayed against the foam net 8. The air from the fan 2 blows the atomized liquid mixture through the foam net 8, thus achieving light foam, i.e. foam with a high expansion ratio.

In addition the water jets from the nozzles 5 will lose most of their energy when they strike the grid 9. This makes it possible to use a much higher water pressure than that employed by previously known foam generators, e.g. 10 bar.

With even atomization of the liquid mixture and with higher velocity of air flow and a greater volume of air the expansion ratio can be increased. A high expansion ratio has many technical and financial advantages. A smaller number of foam generators is required in an installation, and this also reduces the amount of piping required. Foam with a high expansion ratio is generated with a smaller volume of water, thus enabling the tank capacity to be reduced. These advantages are achieved with the present invention.

I claim:

1. An apparatus for producing fire-fighting foam comprising a fan, a reaction jet motor connected to said fan for rotating said fan, a source of liquid under pressure including a foaming agent, said reaction jet motor having a plurality of nozzles shaped to dispense the liquid in a straight, cohesive and compact jet with maximum thrust, said nozzles being connected with the liquid source so as to effect dispensing of the liquid in such a manner that the reaction forces from the nozzles will operate the fan to thereby establish air flow that forces air and the liquid through a foam net, said apparatus including between said foam net and said nozzles a grid mounted parallel to the foam net, said grid providing means for atomization and dispersion of the liquid to thereby enable the liquid to cover the entire foam net.

2. An apparatus according to claim 1, characterized in that the liquid jets from the nozzles (5) are directed towards the grid (9).

3. An apparatus according to claim 2, characterized in that the grid (9) consists of laths (10) located along the circumference of a circle and parallel to the foam net (8).

4. An apparatus according to claim 1, characterized in that the laths (10) are made of wires with a circular, cross section.

5. An apparatus according to claim 4, characterized in that the laths (10) are located from 10 mm to 60 mm apart.

6. An apparatus for producing fire-fighting foam comprising a fan, a reaction jet motor connected to said fan for rotating said fan, a source of liquid under pressure including a foaming agent, said reaction jet motor having a plurality of nozzles shaped to dispense the liquid in a straight, cohesive and compact jet with maximum thrust, said nozzles being connected with the liquid sources so as to effect dispensing of the liquid in such a manner that the reaction forces from the nozzles will operate the fan to thereby establish air flow that forces air and the liquid through a foam net, said apparatus including between said foam net and said nozzles a grid mounted parallel to the foam net, said grid providing means for atomization and dispersion of the liquid to thereby enable the liquid to cover the entire foam net, said grid being located coaxially inside said foam net and being cylindrical in shape and with said reaction jet motor located at the center thereof.

* * * * *